United States Patent [19]

Panson

[11] Patent Number: 4,927,492

[45] Date of Patent: May 22, 1990

[54] ETCHING PROCESS FOR ZIRCONIUM METALLIC OBJECTS

[75] Inventor: Armand J. Panson, Pittsburgh, Pa.

[73] Assignee: Westinghouse Electric Corp., Pittsburgh, Pa.

[21] Appl. No.: 352,673

[22] Filed: May 10, 1989

Related U.S. Application Data

[63] Continuation of Ser. No. 91,225, Aug. 31, 1987, abandoned.

[51] Int. Cl.[5] ..... C23F 1/00

[52] U.S. Cl. ..... 156/642; 156/664; 436/55; 436/83; 134/3

[58] Field of Search ..... 156/642, 626, 664; 436/55, 83; 134/3, 10, 13, 41; 422/62; 423/489, 81

[56] References Cited

U.S. PATENT DOCUMENTS

| | | | |
|---|---|---|---|
| 2,827,724 | 3/1958 | Edds | 156/626 |
| 3,007,769 | 11/1961 | McCord et al. | 423/4 |
| 3,048,503 | 8/1962 | Foote et al. | 134/13 |
| 3,125,474 | 3/1964 | Watkins et al. | 134/3 |
| 3,959,046 | 5/1976 | Bussmann et al. | 156/626 |
| 4,105,469 | 8/1978 | Megy et al. | 134/3 |
| 4,395,302 | 7/1983 | Courduvelis | 156/642 |

FOREIGN PATENT DOCUMENTS

| | | | |
|---|---|---|---|
| 2828547 | 1/1980 | Fed. Rep. of Germany . | |
| 53-103942 | 9/1978 | Japan | 156/642 |
| 53198263 | 5/1981 | Japan . | |

*Primary Examiner*—Kenneth M. Schor

[57] ABSTRACT

A process is disclosed for determining the dissolved zirconium content of a hydrofluoric acid-nitric acid etching bath for zirconium articles by determining the rise in temperature of a volume of the bath upon immersion therein of a known quantity of zirconium metal, immersing a known quantity of zirconium metal into a portion of the bath, measuring the rise in temperature over a predetermined period of time of said portion, determining the dissolved zirconium content of the bath as a function of the rise in temperature, and treating the bath dependent upon the dissolved zirconium content so determined to be in the bath.

8 Claims, 2 Drawing Sheets

ETCHING PROCESS FOR ZIRCONIUM METALLIC OBJECTS

This application is a continuation of application Ser. No. 091,225, filed Aug. 31, 1987, now abandoned.

FIELD OF THE INVENTION

The present invention relates to a process for etching metallic objects formed from zirconium or a zirconium alloy and specifically to a process for determining when an etching bath should be regenerated.

BACKGROUND OF THE INVENTION

Zirconium components are especially preferred in nuclear reactor systems such as nuclear fuel cladding. As described in my co-pending application Ser. No. 888,293 filed Jul. 22, 1986 and now Pat. No. 4,738,747, assigned to the assignee of the present invention, and incorporated by reference herein, zirconium alloy tubes are pilgered to reduce the size thereof, and are subsequently etched to remove defects from the tubing surface. The preferred zirconium alloys for use in nuclear fuel cladding include Zircaloy-2 and Zircaloy-4. An aqueous hydrofluoric acid - nitric acid etching bath is the preferred etching medium. It is known that the etching rate of such an aqueous bath decreases with use, upon dissolution of zirconium into the bath, until a limiting rate of about 20 percent of the fresh or initial bath is reached. At such a stage, the used or spent bath, which will generally contain about 24 g/l of dissolved zirconium alloy was discarded. The spent bath was treated to render it disposable before being discarded. The spent bath contains, among other components, various zirconium compounds or complexes, some tin components when Zircaloy is etched, and residual hydrofluoric and nitric acids.

In my previous co-pending application, Ser. No. 888,293, I provided a process for etching zirconium articles where a spent bath is replenished in acid to increase the etching rate thereof without the need to remove dissolved zirconium from the bath. Such a process extends the life of a hydrofluoric acid-nitric acid etching bath without a need for precipitating and removing dissolved zirconium material therefrom.

In order for an operator to know when an etching bath is spent to the extent that the same should be either regenerated or discarded, the dissolved zirconium content of the bath must be determined. One method of determining the dissolved zirconium content of an etching bath is to remove a sample of the bath and analyze the same in a laboratory to ascertain the zirconium content, a time consuming and costly process. Other faster and less costly procedures have been proposed, but as described in published German Patent Disclosure No. 28 28 547, the determination of zirconium metal content in hydrofluoric acid containing etching baths by colorimetric or titrimetric methods is not feasible. In said German patent disclosure, the zirconium content of a hydrofluoric acid-nitric acid etching bath is determined by drawing off a portion of the bath, precipitating the metal in the portion in a form of a difficult to dissolve compound, and determining the concentration of the difficult to dissolve compound in a diluting agent by measuring the turbidity thereof. The preferred precipitating agent is a solution of caustic soda which precipitates the zirconium in the form of zirconium hydroxide, and water to adjust to the necessary dilution.

It is an object of the present invention to provide an efficient and economical process for determining the zirconium metal content of a hydrofluoric acid-nitric acid zirconium metal etching bath.

SUMMARY OF THE INVENTION

A process is provided for determining the dissolved zirconium content of a hydrofluoric acid-nitric acid etching bath for zirconium articles.

An initial determination is made of the rise in temperature of a predetermined volume of the aqueous etching bath upon immersion of a known quantity of a zirconium article, having a known surface area, therein, over a known period of time, as a function of the dissolved zirconium content of the bath. After this determination is made, the dissolved zirconium content of the bath at various times during an etching process is determined by immersing a known quantity of a zirconium metal object having a known surface area into a portion of the bath having the predetermined volume, measuring the rise in temperature of the bath portion over a predetermined time period, and then determining the dissolved zirconium metal content of the bath as a function of the rise in temperature.

Preferably, only a small volume of the bath is used by separating or otherwise segregating the predetermined volume from the bulk of the bath, and immersing the zirconium metal object therein while stirring the bath portion and measuring the temperature rise by use of a thermocouple immersed in the bath portion.

DETAILED DESCRIPTION

The present process provides a calorimetric method for determining the loading of zirconium in an etching bath so as to provide an indication of when the bath should be replenished or replaced. The process thus provides a practical method for determining the dissolved zirconium content or loading of aqueous hydrofluoric acid nitric acid etching baths for nuclear fuel cladding.

In conventional etching of zirconium metal articles, such as Zircaloy-4 nuclear fuel cladding tubing, etching is used for surface .polishing and also to increase the inside diameter of the tubing. The articles are etched by being immersed into an aqueous acid bath. Current etching baths for such articles can use horizontal unstirred etching baths that contain an aqueous solution of 2 to 4 percent, preferably 2 or 3 percent, by weight hydrofluoric acid and 12 to 35 percent, preferably 15 percent, by weight nitric acid. The Zircaloy-4 tubes are immersed in the bath for a predetermined period of time, with the immersion duration increased for a given increase of inside diameters of the tubes due to the exhaustion of bath strength with use.

The contact of the zirconium metal article with the etching bath results in dissolution of metallic components, particularly zirconium metal in ionic or complex form, in the bath and hydrofluoric acid and nitric acid are consumed such that the activity of the bath must be either regenerated or the bath discarded and fresh etching solution provided.

The present process comprises a calorimetric method for determining the dissolved zirconium content of an etching bath at any desired time during use of the bath for etching of zirconium metal articles.

An initial determination is made of the rise in temperature of a predetermined volume of the aqueous etching bath upon immersion of a known quantity of a zirconium metal article, having a known surface area, over a known period of time, as a function of the dissolved zirconium content of the acid bath. This information then allows the bath loading to be determined by simple measurement of temperature increase for a given etching time. The dissolved zirconium content of the bath at various times during an etching process can then be determined by immersing a known quantity of a zirconium metal object having the known surface area into a portion of the bath having the predetermined volume and measuring the rise in temperature of the bath portion over a predetermined time period. The dissolved zirconium content of the bath can then be determined as a function of the rise in temperature by comparing the measured rise in temperature of the bath portion having the unknown concentration of zirconium over the predetermined time period with the information initially obtained for baths having a known concentration of zirconium.

Figure 1:
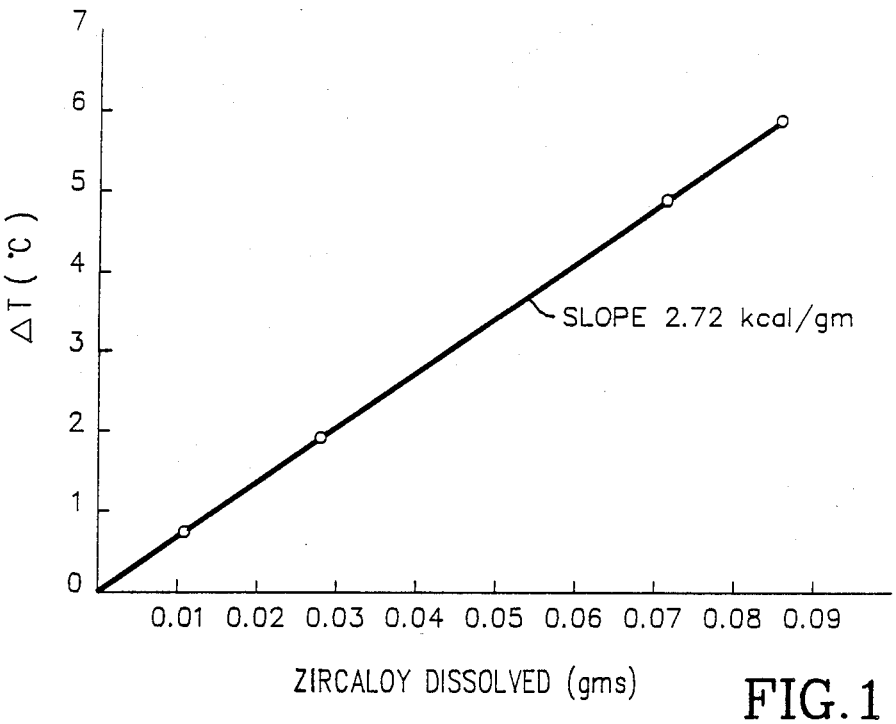
FIG. 1 is a graphic illustration showing the proportionality of the temperature rise to weight of Zircaloy-4 in an aqueous $HF-HNO_3$ etching bath.

The concept of the invention can be illustrated with reference to FIGS. 1, 2 and 3. A 1-inch length of Zircaloy-4 tubing (typically 0.375 inch outer diameter and wall thickness of 0.023 inch), of known surface area, was immersed in a 40 ml portion of the hydrofluoric acid (2%)-nitric acid (15%) aqueous etching bath. The bath was agitated with a magnetic stirring bar and the temperature rise of the bath portion over a one minute time period was measured. As illustrated in FIG. 1, a temperature rise of 1° C. was observed when the dissolved zirconium content of the portion was about 0.012 gms; a rise of about 2° C. corresponded to a content of about 0.028 gms; a rise of about 5° C. corresponded to a content of about 0.072 gms; and a rise of about 6° C. corresponded to a content of about 0.085 gms. The temperature rise is proportional to the weight of zirconium dissolved in the acid bath, with the temperature increase due to the heat of the dissolution reaction, which was determined to be about 2.72 kcal/gm Zircaloy-4 dissolved.

It is known that the etching rate of a hydrofluoric acid-nitric acid bath for zirconium metals decreases as the bath loading or dissolved zirconium content of the bath increases. As described in my aforementioned copending application, etch rates of the bath decrease with use until a limiting rate of about 20 percent of the fresh or initial bath is reached. FIG. 2 illustrates graphically the etching rate of the previously described Zircaloy-4 sample in a 2% hydrofluoric acid-15% nitric acid aqueous etching bath versus the loading, or dissolved zirconium content, of the bath. A linear decrease of etch rate with loading of 0.241 (mgs zirconium to be dissolved/min $cm^2$ zirconium metal object)/(gm dissolved zirconium/liter bath) was observed. It can be further understood from FIG. 2, that by the time that the acid bath contains about 24 gm dissolved zirconium per liter of bath, the etch rate of the bath is only about 0.5 mgs zirconium/min $cm^2$ zirconium metal object. This rate is so slow that the acid bath should be rejuvenated when the bath loading reaches the level of 24 gm dissolved zirconium per liter of bath.

Figure 2:
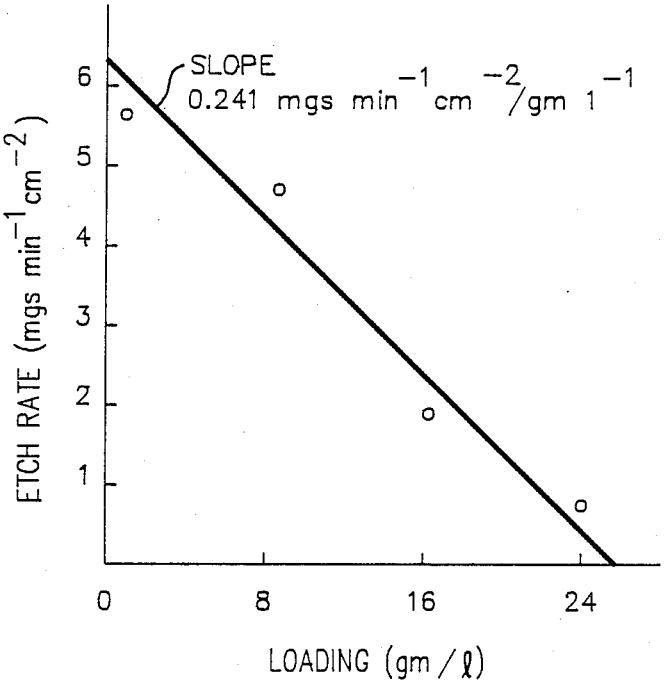
FIG. 2 is a graphic illustration showing the decrease in etching rate versus loading of dissolved zirconium content of an aqueous $HF-HNO_3$ etching bath.
Figure 3:
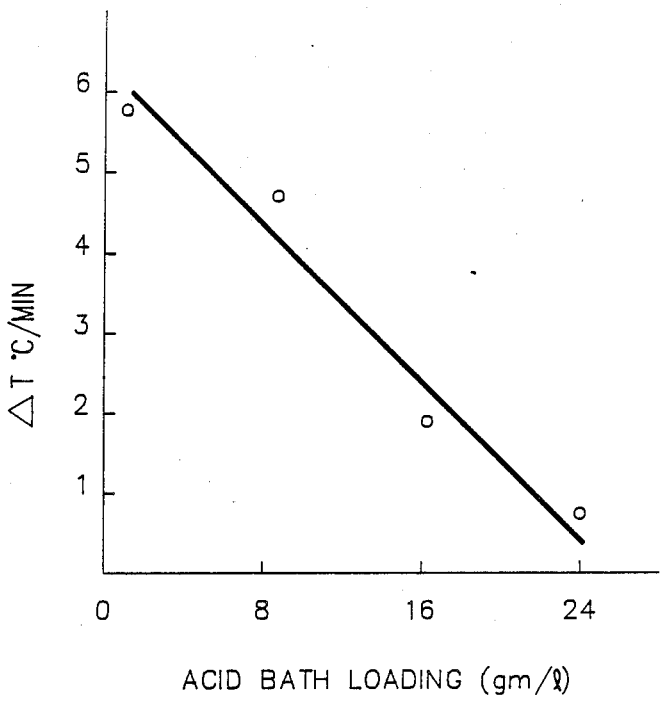
FIG. 3 is a graphic illustration showing the relationship between temperature increase and bath loading of dissolved zirconium content in an aqueous $HF-HNO_3$ bath.

From a combination of FIGS. 1 and 2, it can be seen that, as illustrated in FIG. 3, the rise in temperature (T° C./Min.) of the acid bath when the previously described Zircaloy-4 sample is immersed therein is inversely proportional to the acid bath loading, grams per liter (g/l). Further from FIG. 3, it can readily be seen that the unknown zirconium concentration of an acid bath can be determined by first immersing several of the previously described Zircaloy-4 samples in separate acid baths of various known zirconium concentrations for a minute and measuring the temperature rise of the baths at the end of that minute. Another of the previously described Zircaloy-4 samples is then immersed in the acid bath of unknown zirconium concentration for a minute and the temperature rise after one minute can then be compared with the previously determined temperature rise after one minute of baths of known zirconium concentration to determine the unknown zirconium concentration of the acid bath having the unknown zirconium concentration.

The zirconium concentration of the acid bath can be determined in this way several times during the etching process until the zirconium concentration of the bath is such that the bath needs to be rejuvenated.

The present process is useful in etching of articles, such a nuclear fuel cladding, that are composed of zirconium or a zirconium alloy such as Zircaloy-2 or Zircaloy-4. The alloy Zircaloy-2 contains, by weight, about 1.2 to 1.7 percent tin, 0.07 to 0.20 percent iron, 0.05 to 0.15 percent chromium, and about 0.03 to 0.08 percent nickel, the balance being zirconium, while Zircaloy-4 contains, by weight, about 1.2 to 1.7 percent tin, 0.12 to 0.18 percent iron, and 0.05 to 0.15 percent chromium, the balance being zirconium.

The etching process is effected at atmospheric pressure and ambient temperature, although upon exothermic reaction of the acids and the metal, an increase in bath temperature will result. Temperatures of between about 20° C. and 50° C. are generally used.

Generally, only a small volume of the acid bath of unknown zirconium ion concentration needs to be tested, by separating or otherwise segregating the predetermined volume of the acid bath from the bulk of the acid bath, and immersing the zirconium object therein while stirring the acid bath portion and measuring the temperature rise by use of a thermocouple immersed in the bath portion.

A test of the present invention was effected on a plant scale etching system. During the plant test, a sample of spent etch bath was measured using the present calorimetric method to determine the zirconium content of the bath. The etching bath contained about 500 gallons of aqueous nitric acid hydrofluoric acid solution (2%HF—15%$HN0_3$), and was used to etch final-size Zircaloy-4 fuel cladding. The tube lengths were about 12 feet. The etching was carried out on successive lots of these tubes until the bath was judged to be exhausted by the operator based on experience with the immersion time required to achieve a required size reduction. A 40 ml sample of the spent bath was removed and showed a temperature increase of 0.4° C. after a one inch length of final-size Zircaloy-4 tubing was immersed in the sample, with the sample stirred, for one minute duration. A comparison of the data of FIG. 3 showed that this temperature rise indicates the bath loading to be 24 g/l. This value confirms to expectations based on previous experience using such etching baths.

Figure 4:
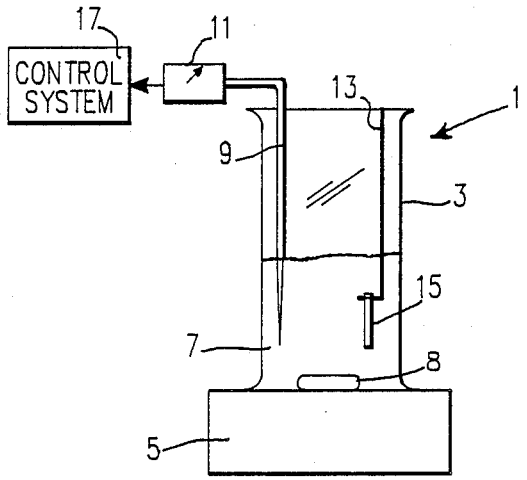
FIG. 4 is a schematic illustration of an apparatus for use in carrying out the present process.

A schematic illustration of an apparatus 1 for carrying out the present process is illustrated in FIG. 4. A vessel 3, such as a plastic container, is disposed on a magnetic stirrer 5, for receipt of a predetermined volume of an acid bath 7, from a vat containing an existing etching bath, the zirconium content of which is to be measured. A plastic coated magnetic stirring bar 8 is placed in the bath, and a thermocouple 9 inserted into the bath which is connected to a thermocouple detector 11 for temperature readings. A plastic support 13 extends from a base (not shown) to a location within the bath 7. A known quantity of zirconium metal 15, having a known surface area, is suspended on the plastic support 13 within the bath and the bath agitated by actuation of the magnetic stirrer 5 and movement of the magnetic stirring bar 8. The temperature rise of the bath 7 over a predetermined time period, such as a minute, is measured. This temperature rise is then used to determine the zirconium content of the acid bath. The thermocouple detector 11, as illustrated may be associated with a control system 17, that will determine the amount of fresh acid to be added to the existing etching bath to regenerate the same.

The present process thus provides a calorimetric measurement and control of an etching process, a simple, direct, and inexpensive process to provide production control measurements for etching operations. The process provides for on-line detection of bath loading and etching rates and forms the basis for production control systems.

What is claimed is:

1. In a process for etching of zirconium metallic articles formed from zirconium or a zirconium alloy, wherein said zirconium metallic articles are contacted with a bath of aqueous hydrofluoric acid-nitric acid etching solution in a tank and zirconium dissolves into the bath, and the etching rate of the bath decreases as the zirconium content of the bath increases, and wherein, depending upon the zirconium content of the bath, the bath may then be (1) replenished with acid and further utilized to etch additional zirconium metallic articles, (2) further utilized to etch additional zirconium metallic articles without being replenished with acid, or (3) discarded from the tank, the improvement comprising the steps of:

(a) providing a predetermined volume of a bath of an aqueous hydrofluoric acid-nitric acid etching solution having a known dissolved zirconium content;

(b) immersing an object having a known quantity of a zirconium metal and having a known surface area into said predetermined bath volume;

(c) determining the rate of the rise in temperature of said predetermined volume of said bath over a known period of time upon immersion of said zirconium metal object which rate of rise depends upon the dissolved zirconium content of said bath;

(d) repeating steps (a), (b) and (c) with at least one other known dissolved zirconium content to develop a correlation between the rate of temperature rise in a known time period and the dissolved zirconium content of the bath;

(e) etching zirconium metal articles in the bath of said tank;

(f) providing a portion of said bath of step (e) after etching said zirconium metal articles, said portion having a predetermined volume;

(g) immersing an object having a known quantity of a zirconium metal, and having a known surface area into said portion of said bath having a predetermined volume;

(h) measuring the rate of rise in temperature of said bath portion due to dissolution of said zirconium metal object therein over a predetermined period of time; and (i) determining the dissolved zirconium metal content of said bath of step (e) by comparing said measured rate of rise of temperature of said bath portion of step (f) with said previously developed correlation.

2. The process for etching as defined in claim 1 wherein, in order to carry out step (f), said portion of said bath of step (e) is removed from said bath of step (e) and transferred to a vessel wherein said measuring is effected.

3. The process for etching as defined in claim 1 wherein, after step (i), said bath of step (e) is treated by regenerating the same and further etching of zirconium metallic articles effected in said regenerated bath.

4. The process for etching as defined in claim 1 wherein, after step (i), said bath of step (e) is treated by removing the same from said tank and discarding the same.

5. The process for etching as defined in claim 1 wherein said articles are composed of by weight, about 1.2 to 1.7 percent tin, 0.12 to 0.18 percent iron, and 0.05 to 0.15 percent chrom the balance being essentially zirconium.

6. The process for etching as defined in claim 5 wherein said articles comprise nuclear fuel clad tubing.

7. A process of determining the dissolved zirconium content of an aqueous hydrofluoric acid-nitric acid etching bath for zirconium metal objects comprising:

(a) providing a predetermined volume of an aqueous hydrofluoric acid-nitric acid etching bath having a known dissolved zirconium content;

(b) immersing an object having a known quantity of a zirconium metal and having a known surface area into said predetermined volume;

(c) determining the rate of rise in temperature of said predetermined volume of said bath upon immersion of said known quantity of said zirconium metal object having a known surface area therein over a known period of time;

(d) repeating steps (a), (b) and (c) at different known dissolved zirconium contents to develop a correlation between the rate of temperature rise in a known time period and the dissolved zirconium content of the bath;

(e) etching a zirconium metal object in a tank having an etching bath of aqueous hydrofluoric acid-nitric acid etching solution;

(f) immersing an object having a known quantity of zirconium metal and having a known surface area into a portion of said bath of step (e) having said predetermined volume;

(g) measuring the rate of rise in temperature of said bath portion due to dissolution of said zirconium metal object therein over a predetermined period of time; and (h) determining the dissolved zirconium metal content of said bath of step (e) by comparing said measured rate of rise of temperature of said bath portion of step (f) with the previously developed correlation.

8. The process of determining the dissolved zirconium content of an aqueous hydrofluoric acid-nitric acid etching bath as defined in claim 7 wherein, to provide said portion of said bath of step (e) such that steps (f) and (g) can be carried out, said portion of said bath of step (e) is removed from an existing bath and transferred to a vessel wherein said measuring is effected.

* * * * *